US007637060B2

(12) United States Patent
Starheim et al.

(10) Patent No.: US 7,637,060 B2
(45) Date of Patent: Dec. 29, 2009

(54) SIDE ACCESS CONTAINER, GARAGE, BUILDING, OR SHELTER

(76) Inventors: Scott A. Starheim, 2674 N. Woodfield Dr., Wasilla, AK (US) 98654; Bruce D. Ross, 2749 45th Ave. SW., Seattle, WA (US) 98116

( * ) Notice: Subject to any disclaimer, the term of this patent is extended or adjusted under 35 U.S.C. 154(b) by 61 days.

(21) Appl. No.: 11/594,039

(22) Filed: Nov. 6, 2006

(65) Prior Publication Data

US 2008/0104890 A1 May 8, 2008

(51) Int. Cl.
*E04B 7/16* (2006.01)

(52) U.S. Cl. ..... 52/69; 52/66; 52/71; 296/183.1

(58) Field of Classification Search ..... 52/64, 52/66, 79.5, 6, 7, 68, 69, 71; 49/96, 97, 104, 49/108, 109, 105, 106, 116, 118, 122; 296/168.4, 296/182.1, 183.1; 472/3; 135/98, 99, 20.3
See application file for complete search history.

(56) References Cited

U.S. PATENT DOCUMENTS

| | | | | |
|---|---|---|---|---|
| 284,846 | A * | 9/1883 | Herron | 52/66 |
| 893,193 | A * | 7/1908 | Waldmire | 184/3.2 |
| 1,740,350 | A * | 12/1929 | Ingraham | 49/108 |
| 2,920,920 | A * | 1/1960 | Couse et al. | 296/26.02 |
| 3,299,589 | A * | 1/1967 | Hay | 52/71 |
| 4,268,084 | A | 5/1981 | Peters | |
| 4,682,811 | A | 7/1987 | Ooguro | |
| 5,239,776 | A * | 8/1993 | Lhotak | 49/199 |
| 6,890,020 | B2 | 5/2005 | Bush | |
| 6,896,316 | B1 | 5/2005 | Taylor | |
| 6,902,226 | B1 | 6/2005 | Taylor | |
| 6,969,130 | B2 * | 11/2005 | Newton et al. | 312/223.1 |
| 2003/0115808 | A1 * | 6/2003 | Morrow | 52/64 |

FOREIGN PATENT DOCUMENTS

| | | |
|---|---|---|
| GB | 2152448 | 8/1985 |

* cited by examiner

*Primary Examiner*—Richard E Chilcot, Jr.
*Assistant Examiner*—William V Gilbert

(57) ABSTRACT

A building is equipped with gull-wing doors that open the whole or substantially the whole side of the building, thereby providing easy access to the interior which may be used as a roll-through garage or when mounted on a truck or trailer, the invention makes a roll-on-roll-off covered transporter. Similarly as a horse trailer and the like. Fire fighter's rest station, equipment shed, decontamination wash room, vending kiosk, etc.

10 Claims, 8 Drawing Sheets

SIDE ACCESS CONTAINER, GARAGE, BUILDING, OR SHELTER

BACKGROUND OF THE INVENTION

1. Field of Invention

This invention relates to the door operating mechanisms for bins, boxes, shelters, vending kiosks, truck and trailer bodies, utility buildings, and the like where one or both sides are raised for access. In particular, operating mechanisms for raising gull-wing type doors hinged along a ridge pole in the center of the roof, and the like.

As a garage the invention provides convenient drive through capability.

As a transporter for recreational vehicles the invention is a very convenient roll-on roll-off drive through transport and storage unit.

As a storage building, the sides open for access by dolly, fork lift, wheelbarrow, and the like.

As bin, storage building, or vending kiosk, the raised open doors become eves to provide shelter from the weather.

As a truck or trailer body the sides open up for access.

2. Description of Prior Art

British Patent #GB 2,152,448 shows a truck body with a single gull-wing type side/roof panel door. GB 2,152,448 illustrates a hydraulic cylinder pin connected directly between the door and a fixed structure for opening a gull-wing lid/door. A pin connected hydraulic means is very common for lifting roof (lid) panels and side panels. The rotation at the attachment pins provides hinging for accommodating the changes of angle between the hydraulic cylinder and the structure as a door or lid is moved between closed and open positions. No additional mechanism to provide mechanical advantage and employed. The mechanism is simple, but requires the addition of a source of hydraulic pressure, which is seldom available in the applications for the present invention.

U.S. Pat. No. 4,268,084 uses a cable and pulley assembly with a spring as counterbalance for opening a folding gull wing lid/door plus a drop-side portion forming a ramp. The roof/door assembly is operated manually (Column 5, line 4) aided by the counter balancing forces from the spring and weight of the drop-side (ramp) which may be stepped on to complete the operation. '084 is not a true gull-wing, because the lid and side panel are hingedly connected. A counter arm guides the side panel motion. The whole assembly operates as a pin-connected trapezoid (FIG. 4). The roof/door mechanism described in '084 do not provide any sheltering to the workers or the truck contents from weather as does the present invention.

U.S. Pat. No. 6,890,020 shows a single roof with attached side closing means, in this case a canvas drop panel. '020 also shows the ubiquitous pin attached hydraulic cylinder as the opening mechanism. The lid/side assembly is not a gull-wing, but does open the side when the lid is raised. The similarity to the present invention ends there.

U.S. Pat. Nos. 6,896,316 and 6,902,226, both by William S. Taylor, show a single solid gull-wing door/lid structure hinged at the far side of the truck. It too uses the ubiquitous pin attached hydraulic cylinder as the opening mechanism (FIGS. 2 & 3b). The lid/side doors of '316 and '226 would be too heavy to be practical for using manual or low voltage electric motor lifting.

U.S. Pat. No. 4,682,811 is a multi-mode hinging for side and top doors of a box bin. One of the modes is a gull-wing lid/side door hinged at or near the center of the lid area (FIGS. 2 and 3a). '811, like others, is operated by pin attached hydraulic cylinders. '811 has no sealing means along the hinge lines to prevent ingress of rain or wash water.

Hydraulic lifting means, besides requiring a hydraulic power source, have several other disadvantages. When pinned between fixed and moving structures as illustrated in the above references, the angles of force during some of the range of motion are far from optimum. Indeed, the cylinder has to provide several times as much force in some positions as is required in other positions of the range of motion. Thus the cylinder has to be sized much larger and have more pressure to provide lift from this awkward configuration than is necessary for working over most of the range of motion. When hydraulic cylinders are used in tandem such as one on each end of the lid assembly as is also illustrated in the references, all the cylinders generally receive the same pressure from the power source, causing them to operate with coordinated (equal) force. If one portion of the moving structure requires more force to move, such as may be the case with snow load, damaged or rusty hinges, bending, dents, etc, the moving structure will be lifted unevenly, perhaps doing even more damage to the structure.

The present invention does not require an often absent source of hydraulic power, and the several lifting jacks are operated with coordinated movement, not coordinated force. Thus the gull-wing roof lifts evenly along its whole length.

OBJECTS OF THE INVENTION

1. It is an object of the invention to provide a box with large horizontally hinged side opening doors and the machinery to raise the doors.
2. It is a further object of the invention to use power assist to open the doors
3. It is a further object of the invention to use manual operation to open the doors.
4. It is a further object of the invention to permit a plurality of independently operated doors.
5. It is a further object of the invention to mount the box on a truck or trailer.
6. It is a further object of the invention to provide a shelter roof over openings exposed by the open door.

These and other advantages will be fulfilled by a box or building described by the following specification.

SUMMARY OF THE INVENTION

In the preferred embodiment, two rows of parallel hinges are mounted near the center of the top of a basically rectangular box. The box may deviate from a rectangular parallelopiped shape by having a portion of the top surface sloping, ie, a barn style hip roof. Two edge connected panels are attached to each hinge row. These panels each form a top and one side of a closed box, and when rotated about their respective hinges, are gull-wing type doors and open the box sides for access with high clearance plus weather protecting eves over the users and the contents of the box.

Stiffener bars extending between the lid portion near the hinge and approximately the distal edge of the side portion also serve as the member where lift forces from a jack are applied. In most cases, the stiffeners are located at the ends of the door panels. Additional stiffeners may be inserted between the end stiffeners whenever needed to support the door panels at mid-spans.

The jack may be a screw mechanism, cable, hydraulic or pneumatic piston, rack and pinion, pawl and ratchet, cam, or similar used singularly or in combination. For larger doors, jacks may be placed at both ends and/or mid span to avoid bending and to provide even lift. A coordinating means is incorporated to ensure that all jacks on any one door operate co-operatively. The preferred coordinating means is a shaft driving two or more jack screws from the shaft by bevel or worm gears, or similarly, sprocket gears on the jack screws which are driven by a link chain similar to a bicycle chain or a rubber cog belt similar to an automobile timing belt. Other drive methods are applicable as well, all driven together by a common crank or motor. The doors may also be divided into independent segments each having independent cranks or motors.

The lid portion, or roof, may be flat, rounded, or hipped for additional interior height and/or strength.

A flexible waterproof membrane is attached to the left and right lid portions and cover the hinges to protect the hinges from weather and prevent leakage into the interior of the box in both open and closed configurations.

INDEX OF ELEMENTS SHOWN AND DESCRIBED

Figure 1:
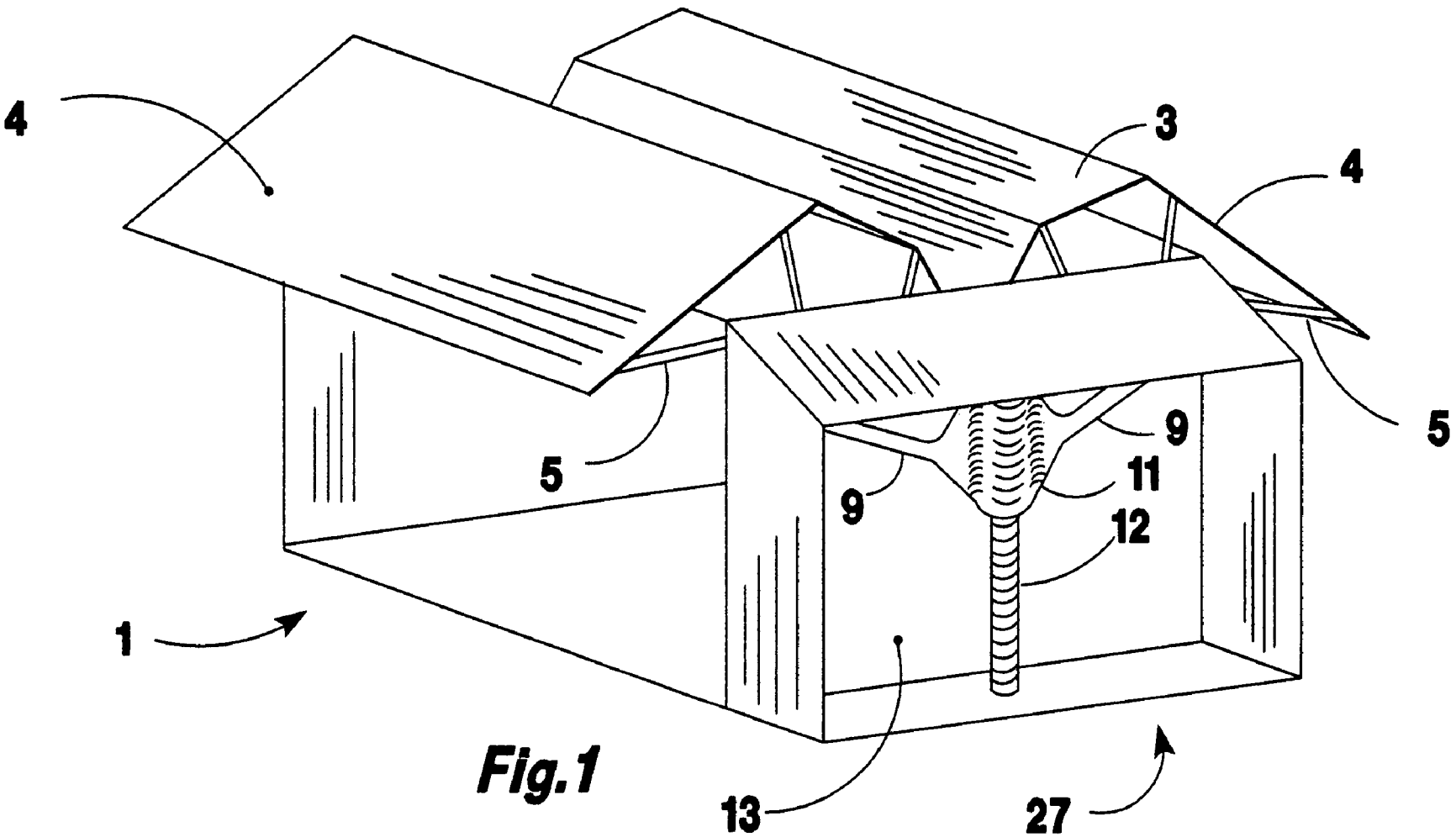
FIG. 1 is an isometric overall view of the invention in place on a box or building.

1. The shed, overall.
2. Roof hinge(s)
3. Roof panel, including hip and valley portions.
4. Side panel
5. Lifting track and structural brace.
5'. Lifting track in open position.
5*a, b* lifting levers for the scissors-lift embodiment.
6. Lifting truck
7. Structural brace
8. Truck wheels
9. Lifting arm
9*a*. Distal portion of lifting arm 5
10. Truck pivoting point
11. Jack nut or slider
12 Jack or guide. Screw jack shown in FIG. 1, Guide shown in FIG. 12.
12' Locus of points corresponding to jack location.
13 Box end panel
14. Turning gear and co-operating screw thread for jack
15. Gear teeth
16. Flexible weather proofing membrane
17. Unused
18. Crank
19*a, b, c, d* Development locus for curved lifting track.
19*e, f, g* Development locus in place to define curved lifting track.
20. Development circle defining curved lifting jack
21. Center of 20
22. Position of 5 if put into horizontal position.
23. Winch
24. Lifting cable
25 Turn pulley
26. Pulley attachment location
27. Equipment porch
28. Curved lifting track
29. Bolt or pin for fixing arm segments together
30 Arm extension receiving slot
31. Wheel slot.
32 Tang portion of the distal portion of the lifting arm.
33. Stop.
34. Guide post for nut. Substituting for the screw jack's guiding characteristic.
35. Brace
36. Lifting lever arm.
37 and 38 pulling point offset struts.
39 Guide
40 Slider
41. Ridge pole or strong back
42 Truck chassis or frame
43 Skid alterative for wheels

DETAILED DESCRIPTION OF THE PREFERRED EMBODIMENT(S)

The drawings do not show various structural elements such as the detail design of the frame, foundation, truck or trailer, etc, associated with the building or box design.

The term jack, and similar is intended to include the various machinery and ways for producing forceful linear motion, including tackle and differential chainhoists. The term cable is generic and includes chains, links, or any device operating in tension that may be substituted for an ordinary cable.

Referring to FIG. 1, the building 1 is equipped with gull-wing doors comprising roof 3 and side panels 4, and a lifting mechanism 9, 11, 12 to operate the doors. The lifting mechanism is shown in a porch 27, but may be inside the building. The porch also provides sheltering for support equipment such as a generator, batteries, space heater, water heater, fuel tanks, tools, etc.

Figure 2:
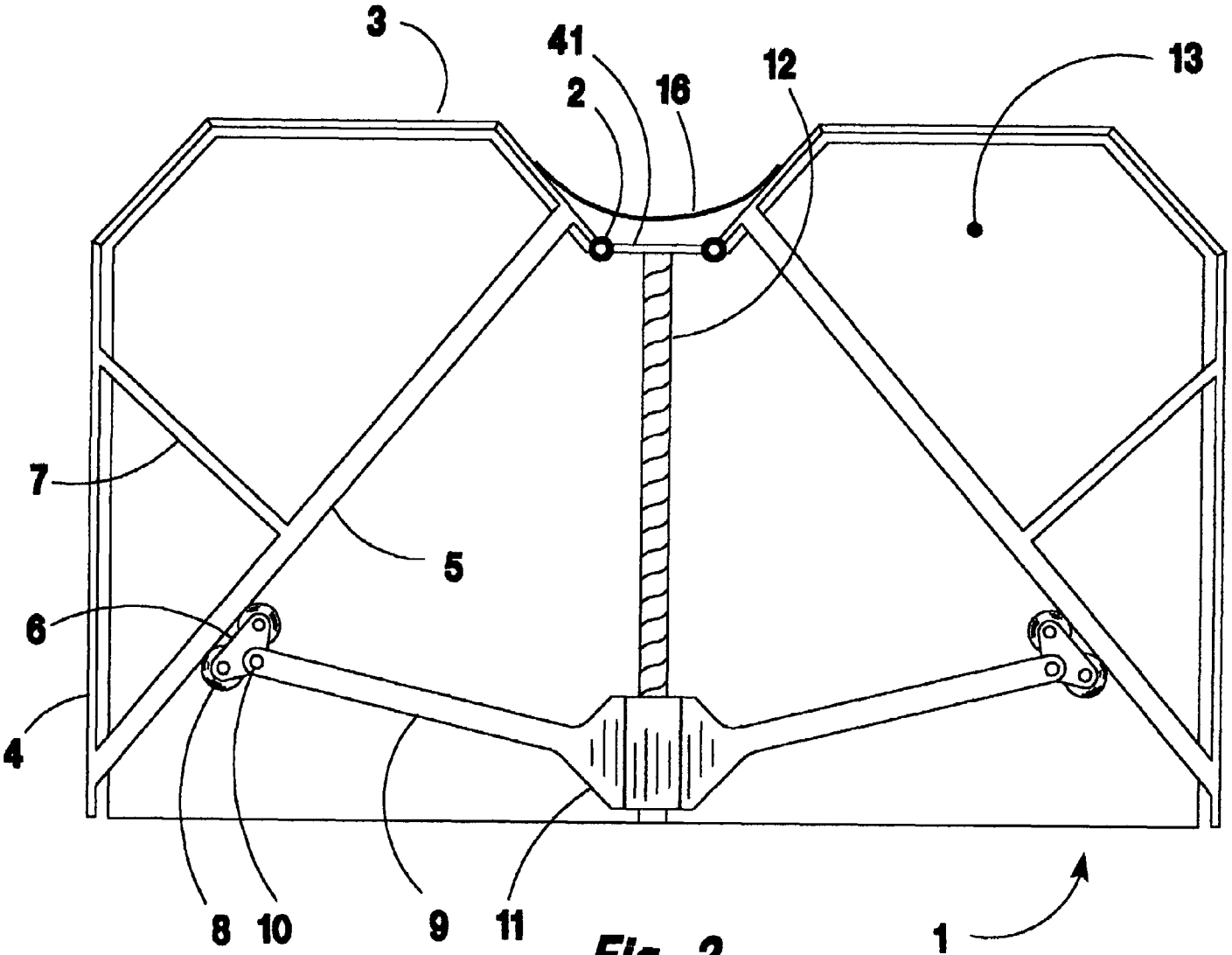
FIG. 2 is the preferred opening mechanism in the door-closed position.

Referring to FIG. 2, box, building, shelter, etc, 1, is fitted with a hinged 2 roof 3 or pair of roofs generally connected to side panels 4 to form a unit hinged at the top of the box. Brace 5 serves as both the track for the wheeled truck 6 and structural bracing providing rigidity of the panel combination. Brace 7 is optional, and serves only to provide structural rigidity to the track and panel assembly. More than one brace 7 may be used as dictated by structural requirements.

Figure 16:
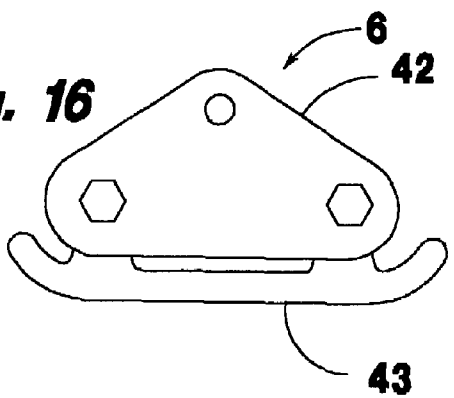
FIG. 16 illustrates a truck means having a skid substituting for the wheels.
Figure 15:
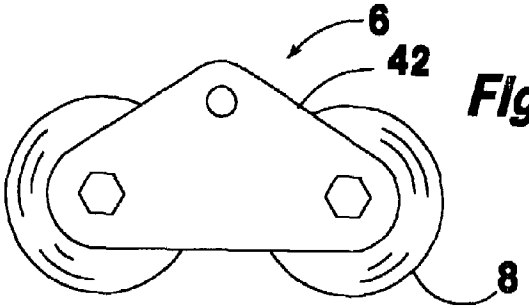
FIG. 15 is an enlargement of a wheeled truck means.
Figure 10:
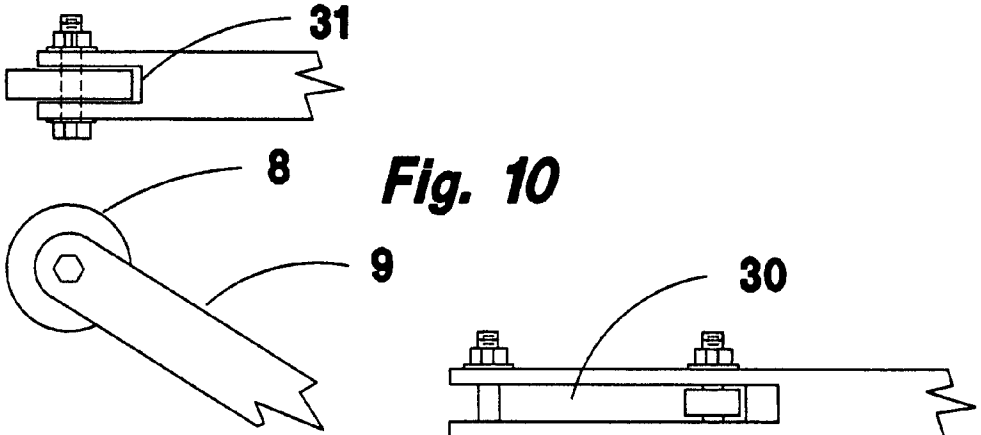
FIG. 10 is plan and elevation views of details of the one-wheel embodiment of the lift truck assembly

Truck 6 consists of at least two wheels 8 and is pivotally mounted 10 to lifting arm 9. Alternatively, a single wheel as illustrated in FIG. 10 may be attached to the end of the lifting arm 9 which is fitted with a suitable axle and wheel mount such as slot 31. A slot or similar is desired to avoid off-center loading of the wheel and arm 9. The truck wheels may be replaced by a skid assembly when loading is small enough that the friction of a skid is tolerable. Referring to FIGS. 15 and 16, the most straightforward way to install a skid is to remove the wheels 8 from the truck chassis or frame 42 and mount a skid assembly 43 re-using the wheel axle bolts. Alternatively the distal edge(s) of the frame 42 may be polished and adapted as a skid without introducing another manufactured part.

Not shown, is a means to keep the truck on the track surface of brace 5. This may be either by providing sufficient stiffness that the truck tracks along the axis of the brace, or better, for more security, a holding means is employed. Typically, such a holding means would be a guiding channel on the track or guide fingers on the truck which extend over the sides of the track to guide the truck along on the brace track.

Lifting arm 9 is fixedly attached to nut 11, which in turn co-operates with jack screw 12 to move the lift arms and trucks which in turn lift the brace 5 and the door assembly.

Lifting arm(s) 9, nut 11, and jack screw 12 together comprise a complete jack machine to forcefully lift the door(s). For the purposes of this invention, cable or chain lifts which in other contexts would be described as hoists or cranes (FIGS. 5, 6, and 12) perform exactly the same function and have the same results, thus are intended to be included within the definition of "jack".

Panel 13 shown is an end wall of the box. It is not part of the innovation, but may serve structural purposes for partly supporting the jack screw, other jack parts, winches, pulleys, motors, etc.

A motor or crank assembly (not shown in FIGS. 1, 2, or 3) drives the jack means in the usual manner of the particular jack design selected. In the case of a screw jack, the motor may turn either the screw or drive a threaded rotating element within the nut assembly. Turning the screw is the preferred option. By turning the screw, a crank remains in the same location and it is easier to replace a crank with a motor. Also, when more than one jack is needed to lift a heavy set of doors, the jacks may be driven by a common shaft or other positive drive (non slipping) mechanism connected to a crank or motor placed at either end, or both ends, of the drive shaft.

Figure 4:
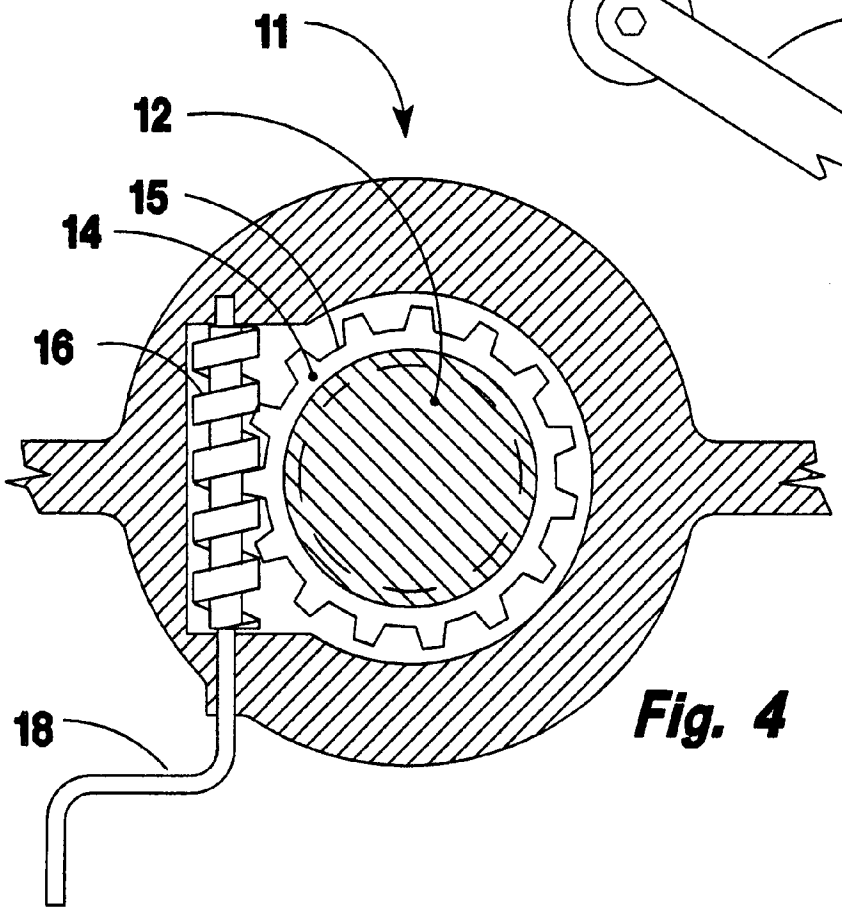
FIG. 4 is a cross section detail of the nut equipped with a crank.

FIG. 4 details an optional crank assembly on the nut. A threaded insert 14 which engages a non-rotating jack screw 12 is fitted with a means to rotate the insert. As shown, this typically will be an attached gear 15 in cooperation with a driving gear. A worm gear 16 turned by a crank 18 is shown, but the worm could be replaced by a smaller pinion gear or a bevel gear. The crank may be replaced by an electric, hydraulic, air, or other motor. Internal bearings supporting the threaded insert and crank are not illustrated, as they would be of conventional design.

A flexible weather proof panel 16 is sealed to the doors and covers the hinges to protect the hinge assembly and box in general from rain and dirt. Suitable gaskets on the door edges would seal the doors against weather.

Other Embodiments and Variations

While a the description is of a screw jack, any means to lift the "nut" 11 would suffice, although with diminished capability For safety, a screw of other non-self releasing supporting jack is preferred. Secondary safety catches are recommended as well.

Figure 3:
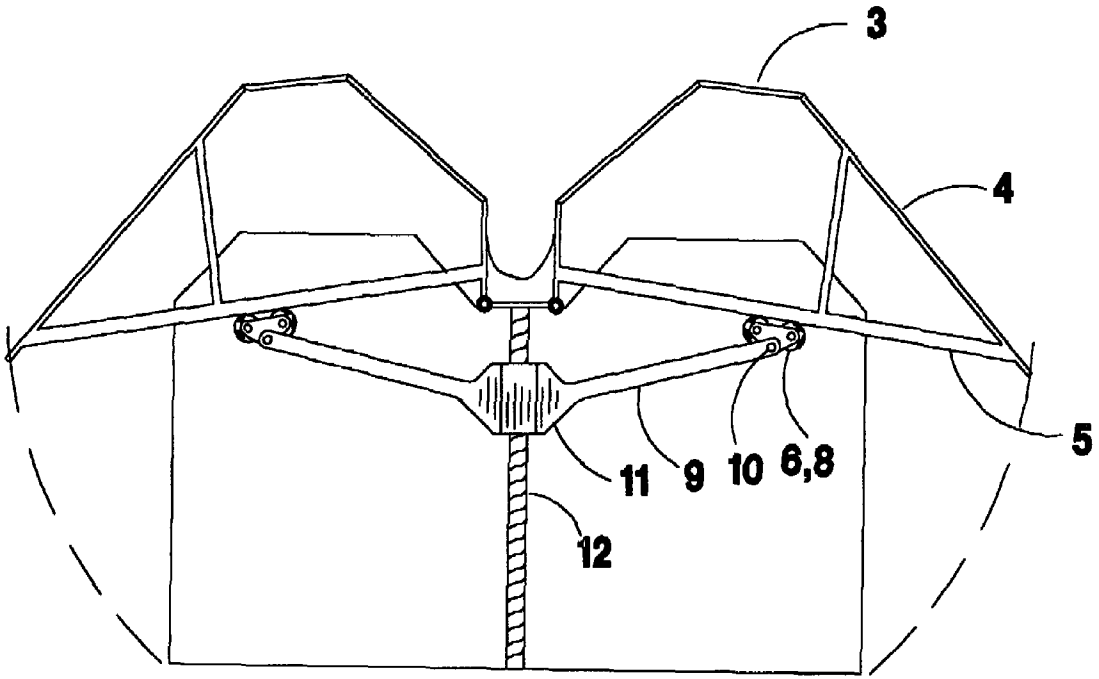
FIG. 3 is the preferred opening mechanism in the door-open position.
Figure 12:
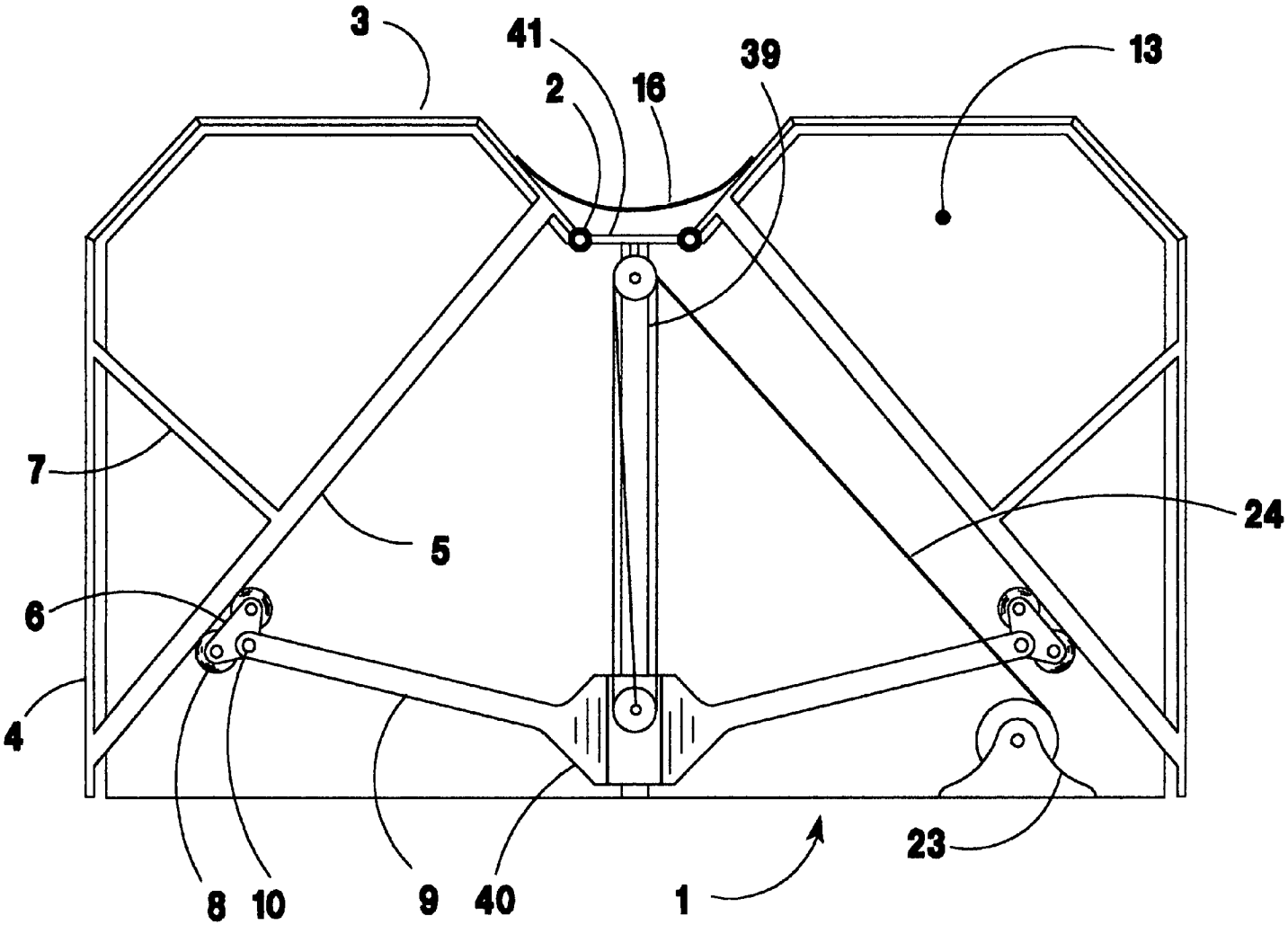
FIG. 12 illustrates a preferred cable lift mechanism as an alternative to the described jack.
Figure 13:
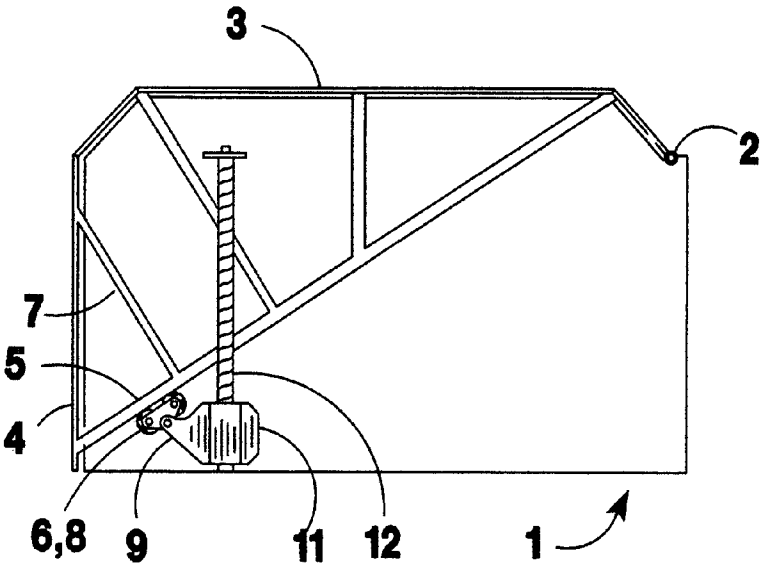
FIG. 13 illustrates a whole-roof-one-door configuration

One embodiment in particular as a substitute for a screw jack is shown in FIG. 12. Cable 24, winch 23, and turn pulleys 25 lift the slider 40, along the same path and function as is shown in FIGS. 2 and 3, only in this embodiment, the "nut" is now a slider which slides along guide 39 where jack screw 12 formerly was.

FIG. 12 shows a three-fall rigging attached at pulley points 26, this is illustrative only. A single fall or even more loops for added mechanical advantage are intended to be included within this disclosure. The winch may also wind two or more cables, each for a similar lift along the hinge line. The added cables can be run through the building to the other lifts.

The winch 28 may be operated by a manual crank, or electric, air, vacuum, steam, or hydraulic motors. A crank or electric motor is preferred because muscle power is always available, and an electric motor may be run off of an automobile or truck electrical system, which will usually be available. A winch is only one of several well known means to pull a cable. Hydraulic and pneumatic piston cylinders are known to be equivalent in some applications. Such may also use cable rigging similar to a reverse operated block and tackle to increase the effective throw of the piston. A differential chain hoist will also be usable to lift the slider up.

Figure 14:
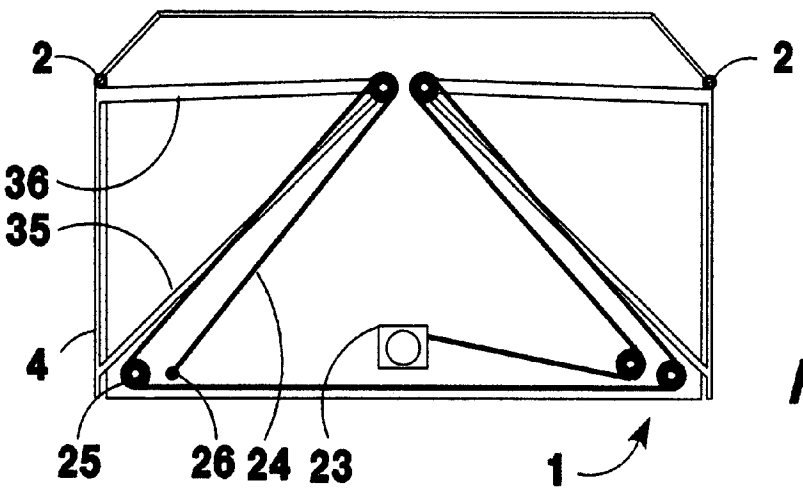
FIG. 14 illustrates a side-only door embodiment.

FIG. 14 illustrates a side panel only door embodiment. The configuration of FIG. 14 is a variant of the embodiment of FIG. 7. Note that in the cable rigging configurations of FIG. 14 and FIG. 7, if one door is latched closed, the entire effort of the cables will automatically be transferred to opening the other door.

Figure 11:
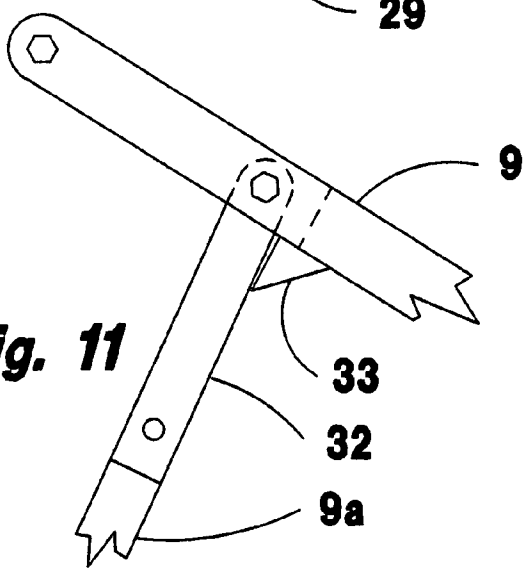
FIG. 11 is plan and elevation views for detail of one embodiment of the detachable lift arm.

A means to disconnect one of the trucks to disable the lift on one door is provided so that only one door is raised. Referring to FIG. 11, the simplest disabling or disconnection means is a pair of pins or bolts 29 on each arm 9 to disconnect or move a portion 9*a* of the arm 9 away from brace 5. FIG. 11 is one embodiment of such a disconnect. Distal portion of arm 9, that is portion 9*a*, is detachably mounted to arm 9 by being held within a slot 30 by bolts or pins 29. Only one bolt or pin need be removed to permit the arm portion 9*a* to swing away from its usual operating position. FIG. 11 shows portion 9*a* as dangling from arm 9. The truck on the end of portion 9*a* will then simply and harmlessly roll along the floor of the porch 27. Stop 33 ensures that the truck will not set vertically on the floor and thus will be positioned so that the resting forces will result in a rolling motion. Portion 9*a* can be totally removed, or swung upward and laid on arm 9. Obviously, this will require re-positioning of at least one of the attaching pin locations from that as shown.

The side walls of slot 30 should each be at least ½ the thickness of the tang portion 32 of arm 9*a*, and obviously, both the tang portion and the slot walls have to be of sufficient size and strength to support the expected applied load during operation.

Obviously, each door may be fitted with its own individual opening machinery. If so fitted, it is recommended that the individual drives be located on an axis approximately at the place shown for the trucks 6 in FIGS. 2 or 3 and that a shaped lifting track be included to minimize off-center loading.

The roof portion may be shaped in any convenient manner to fit the application. The descriptions of the embodiments illustrated show the panels hinged near the center of the building or box, most likely on a strong back or ridge pole. The ridge pole fine structure not illustrated, but may be any structurally sound assembly such as a truss, structural box, angle, channel, I beam, etc, or any attached stiffening elements. Also included in the ridge pole design options is to have the proximal edges (hinged) of the roof stiffened with a bent down edge, or stiffening ribs of any design. With this option, the two roof panels are hinged together, with the hinge line strengthened by a stiffening means integral with the roof panels.

Additional panels and/or curtains may be added to the lower edge of the side panels to serve as awnings, sun-shades, outer walls. Obviously, such a shade panel could be formed by hinging a portion of the side panel itself.

The figures illustrate track brace 5 as a straight element. It is reasonable to curve brace 5, or more precisely, its track function, as a separate track to keep the truck 6 wheels 8 approximately horizontal to reduce the development of useless horizontal components of force which must be resisted by the hinges, jack, and the rest of the structure. This can be done by developing a mathematical function, but easily by graphical means more likely to be understandable by the ordinarily skilled mechanic.

The following illustrates one method of developing such a curve.

Figure 8:
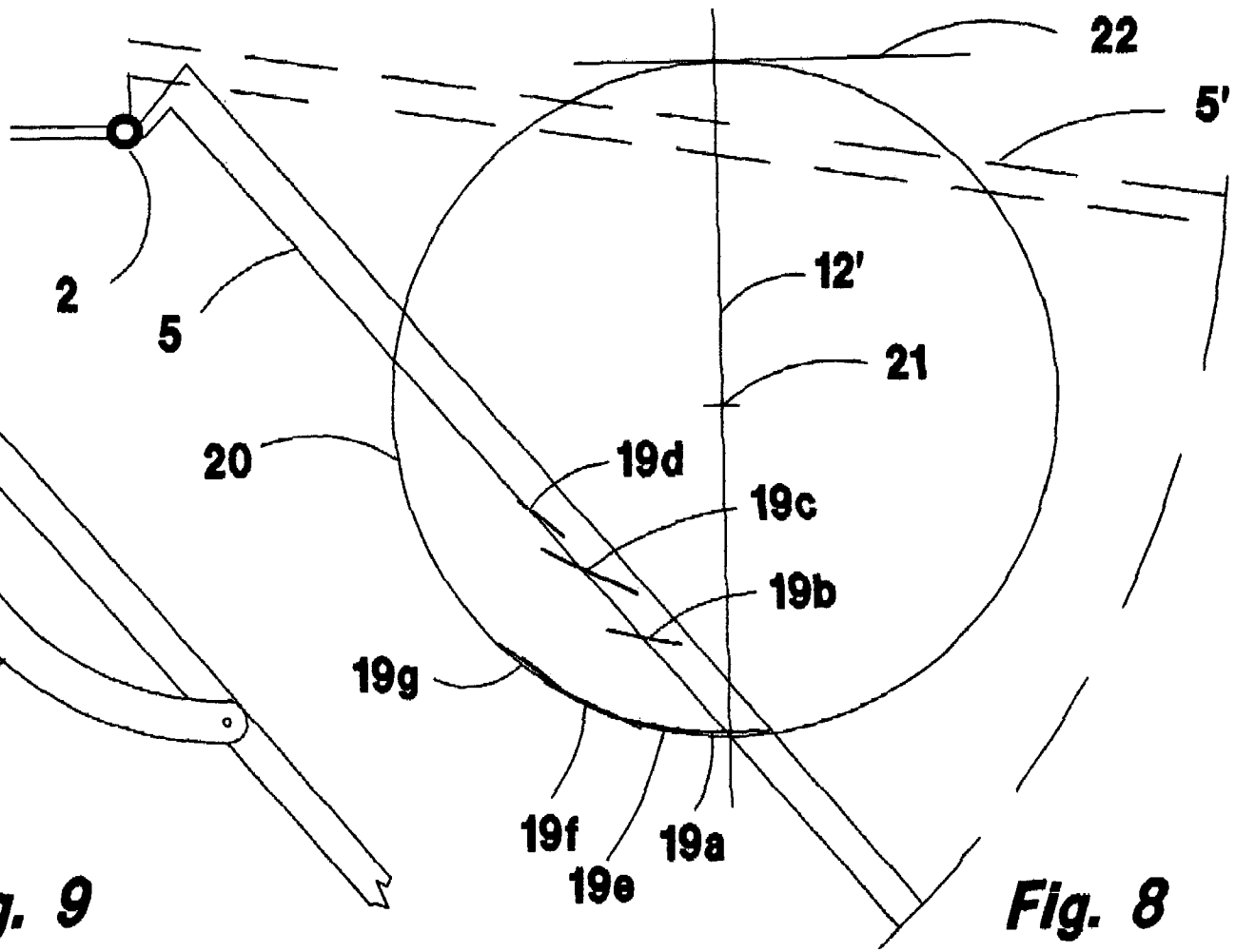
FIG. 8 shows the development of a shaped lift ramp for essentially vertical lift forces.

Referring to FIG. 8:

1. Draft a scale drawing of the track brace 5 and hinge point 2.

2. Draw a short vertical line 12' representing the locus of movement of truck 6.

3. Draw a horizontal line 19*a* at the crossing of the vertical locus and the track.

Note this first horizontal line at the closed position of 5 is the only one in this process that is in its proper physical position.

4. Rotate brace 5 and the previously drawn horizontal line(s) incrementally through its range to 5'.

5. At each increment, draw another horizontal line 19*b, c*, &*d*, at the intersection of the vertical locus 12' and brace 5.

6. Repeat 4-5 to the final position at 5'.

7. Return the brace to the closed position at 5

8. Pull each of the horizontal lines 19*a, b, c*, &*d* down to positions 19*e, f*, &*g* to form a curve with the each other line and the first line.

9. Draw a smoothed curve through the connected lines.

10. It is noticed that, for at least in the example shown, the resulting curve of lifting points is on a circle 20 which has its center 21 on the vertical locus 12' midway between the first horizontal line and the elevation of the brace 5 if rotated to a horizontal position 22. (Whether the brace is or is not expected to actually be rotated to horizontal.)

The resulting curved track will present an approximately horizontal face to the truck at all positions of lift, thereby not producing any horizontal forces tending to bend the jack. Reduction of horizontal and torsional forces is most important when a jack is used to lift only one door. These forces are balanced in the two-door configuration so their elimination is not required.

Figure 9:
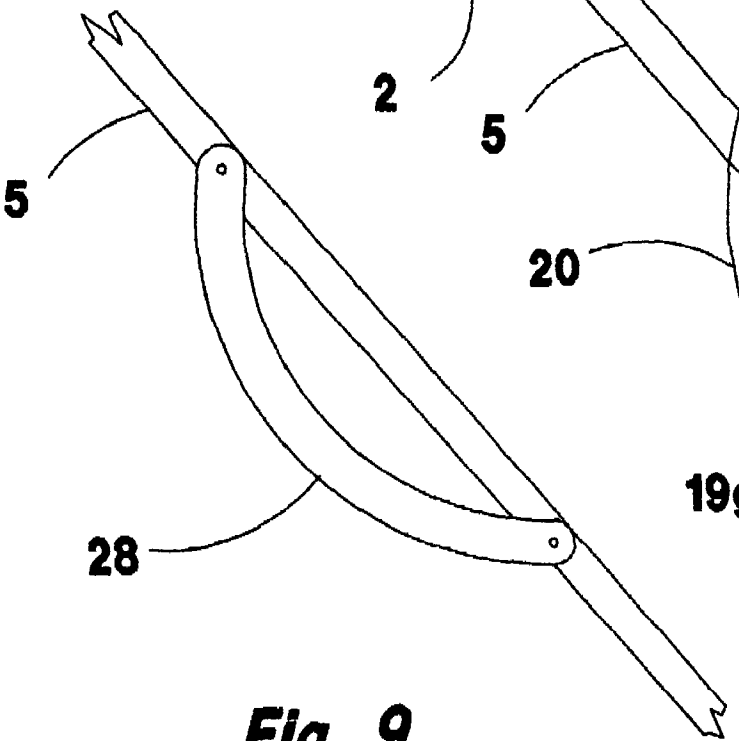
FIG. 9 is a detail of the curved shape lift ramp.

FIG. 9 shows a typical curved lifting track 28 attached to brace 5. When used with a multi-wheeled truck, in the closed position, one wheel may rest directly on brace 5. This is no problem because the combined effective lift will be approximately centered between the extreme wheels and the lift required to move the door in the first portion of its range is small. Alternatively, the curve may be fitted with a short horizontal end section and moved to a location a little below the position illustrated. This will permit all the truck wheels to be on the auxiliary lifting track portion.

Figure 5:
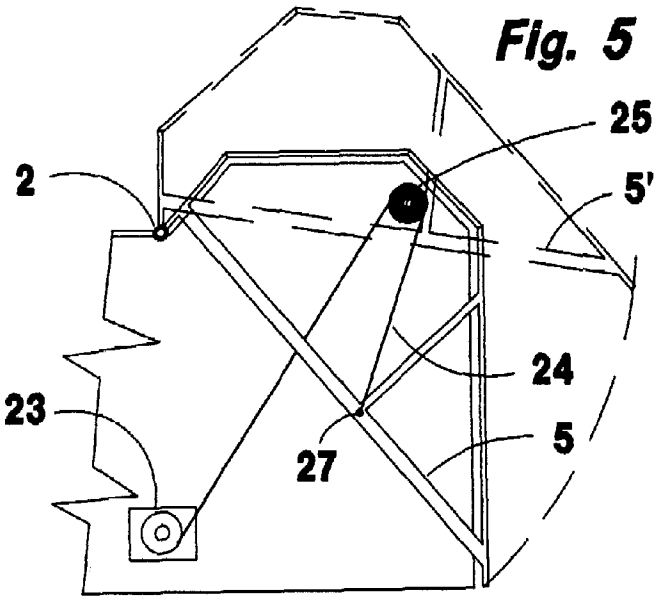
FIGS. 5, 6, and 7 are alternative winch, cable, and lever systems for opening the doors.
Figure 6:
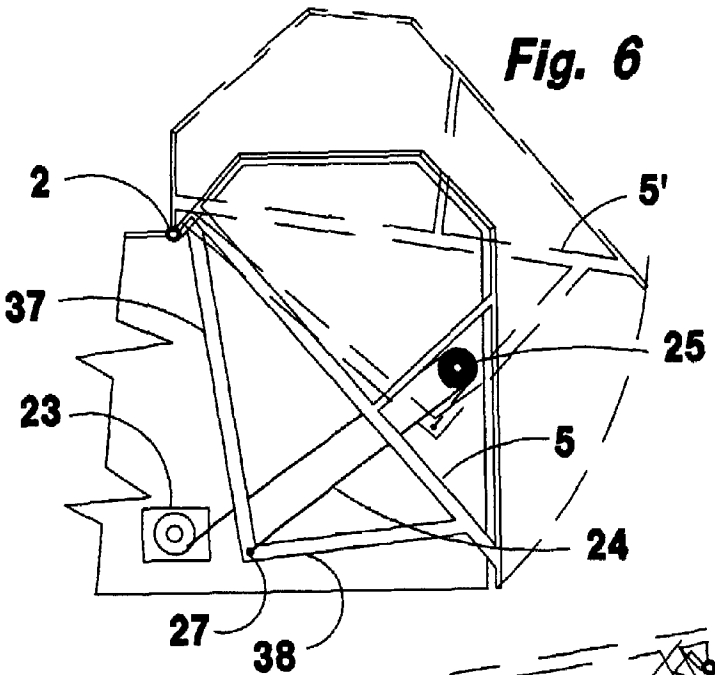

FIGS. 5, and 6 illustrate two cable and winch embodiments of the door opening machinery for the preferred lid/door embodiment. Winch 23 pulls cable 24 which runs through return-pulley 25 and attaches to the door structure at 26. Referring to FIG. 5, The center of pulley 25 is located above the highest elevation of brace 5, and approximately 1 radius from the position of cable attachment point 25. When open to the maximum, this orients the cable segment between the pulley and attachment to an approximately vertical drop, and approximately perpendicular to the brace 5.

Referring to FIG. 6, attachment point is translated by struts 37 and 38 to be closer to the winch, which permits the pulley to be located much lower on the structure. The center of the pulley may be moved from where shown with the last cable segment approximately perpendicular to the brace 5, to a position where the last cable segment is approximately vertical in the raised position. Struts 37 and 38 are shown as two elements for convenience, but they may be compacted into being a single strut attached to brace 5.

A variation of the hoisting jack shown in FIGS. 5 and 6 is instead of fixedly attaching the cable to the lifting brace, it is connected to a truck like element detail 6. As the door is lifted, the truck will move along the lifting brace 5 to keep the cable perpendicular to the lifting brace. The smaller mechanical advantage near the closed position is not a problem because the force to lift the door is minimum in the early portion of the range of door positions, and maximum when open, which is also when the truck will put the cable at its maximum mechanical advantage. The principal advantage of using a moving force applying means is that the amount of cable required to be wound on the winch is less than with a fixed attachment.

The truck track for both embodiments illustrated in FIGS. 5 and 6 maybe straight, convex, concave, or designer shaped to control the movement of the truck for providing optimum mechanical advantage over the range of operation. In the case of the FIG. 6 embodiment, the truck track would be inserted between or onto strut elements 37 and 38.

Figure 7:
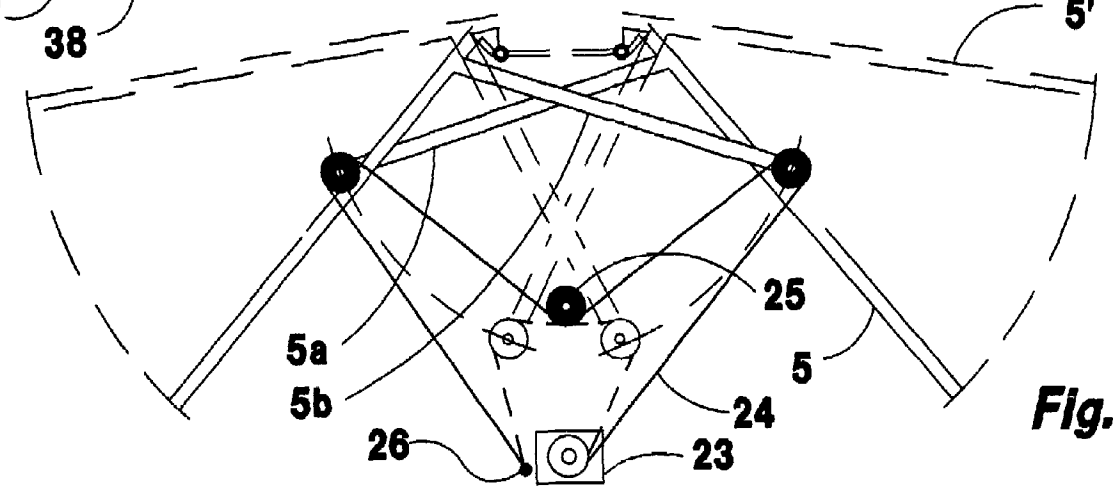

Referring to FIG. 7, lever arms a and 5*b* are oriented to cross, thereby permitting the doors to be opened when he ends are pulled together either by a cable or jack. A hydraulic cylinder, a single screw, or a LH-RH threaded screw like used on roller skate shoe clamps or Jorgenson clamps may be used instead of a cable. Middle pulley 25 is optional, but when placed as shown, it increases the effective pull on the levers without increasing the cable tension. Cross bracing is not illustrated, but may be added if structural analysis suggests a need for it.

The figures show structural elements as solid bars or similar. Various bracing, trussing, and lattice work structures are the structural equivalent of the elements as shown, and are considered to be covered by the attached claims.

How To Use The Invention

The described box with gull-wing lift doors may be mounted on a foundation such as skids, feet, casters, a foundation stand, fork lift pallets, a truck, trailer, railroad car, or any suitable support providing an adequate base to support the box without it being warped. Similarly, the interior is furnished with the equipment, furniture, and fixtures required for the purpose of use.

When it is desired to open the doors of the box or building, any latches or locks are released, the jacks operated as described, and the doors lifted. Safety catches are set, and the building is open and ready for use.

The sequence is reversed to close up the building.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

The embodiments of the invention in which an exclusive property right or privilege is claimed are defined as follows:

We claim:

1. A shelter having at least one lift door for access comprising in combination:

a. a shelter comprising at least one door having a generally vertical door panel and a roof panel fixedly attached to an upper edge of said vertical door panel and extending generally inwardly toward the center of a top of the shelter, and a hinge attaching an inner edge of said roof panel to the top of the shelter, and b. at least one jack fixedly attached in a vertical position for providing continuous vertical lift forces to open said door, and continuous vertical supporting forces while closing said door, and c. at least one brace member extending from the proximity of a lower edge of said vertical door panel to the proximity of the inner edge of said roof panel, said brace member having a portion adapted as a track for receiving a truck traversing said track, said truck being attached to a distal end of an arm extending from a moving portion of said jack to the vicinity of said brace member, and d. whereby, when said jack is raised vertically, said truck rises concurrently and travels along said track continuously lifting and, thereby causing said door to be opened by pivoting on said hinge.

2. The shelter lift door of claim 1 where the truck further includes at least one wheel in contact with said track, where said wheel moves along said track applying lifting forces to various points on said track.

3. The shelter lift door of claim 1 wherein the truck further includes at least one skid in contact with said track, where said truck moves along said track applying vertical lifting forces to various points on said track, thereby raising the track and opening the door as the truck moves along said track.

4. The shelter lift door lifting means of claim 1 where the jack is a screw jack, a screw portion of the jack turns within a cooperating threaded nut, thereby raising or lowering the nut.

5. The shelter lift door of claim 1 further including a flexible waterproof membrane attached to the door and covering the hinge to protect the hinge from weather.

6. The shelter lift door of claim 1 where the shelter further has a second door having a second roof panel attached to an upper edge of the second door and a hinge attaching an inner edge of the second roof panel to the top of the shelter, and further including a flexible waterproof membrane having one edge attached to the first door and the opposite edge attached to the second door, and covering each respective hinge, thereby protecting each hinge from the weather.

7. The shelter lift door of claim 1 where said vertical lift forces and said vertical supporting forces are unaided by forces not derived from said jack.

8. A lift door for providing access to a shelter comprising in combination:

a. a shelter door comprising a generally vertical door panel and a shelter roof portion, said roof portion being at least one panel fixedly attached to an upper edge of said vertical door panel and extending generally inwardly toward the center of a top of the shelter, and a hinge attaching a distal edge of said roof portion to the top of the shelter, and b. at least one track member extending from the proximity of a lower edge of said vertical door panel to the proximity of the distal edge of said roof portion, and c. at least one vertically mounted jack for providing vertical motion and lifting force to raise said door to an open position, and d. said jack further comprising at least one outwardly extending arm having a truck attached to a distal end of said arm, whereby said truck traverses along said track, said truck further comprising at least one wheel or skid, and e. whereby, when said jack is raised, said arm and truck rise and said truck travels along said track, thereby applying lifting forces from said jack to said track, thereby causing said door to be opened by pivoting on said hinge.

9. The shelter lift door of claim 8 where the jack is a screw jack, a screw portion of the jack turns within a cooperating non-turning nut, thereby moving said nut in a vertical direction along said screw.

10. A lift door and lifting means for a shelter comprising in combination:

a. a shelter having front, back, left, right, and top sides and at least one ridge pole approximately centered along the top from the front to the back of said shelter, and b. further comprising left and right door panels each adapted to close openings in the left and right shelter sides, each door panel further comprising a roof portion comprising at least one roof panel, said roof portion having one edge attached to an upper edge of said door panel, and the opposite edge of said roof portion panel hingedly attached to said ridge pole, and c. each said door further comprising at least one track for receiving lifting forces from a vertically mounted door lifting jack, said track extending from the vicinity of a lower edge of the door panel to the vicinity of the opposite edge of said roof panel having said hinge, and d. wherein the jack is a screw jack comprising a freely turning screw and a cooperating jack nut running on said screw, wherein the screw turns within the non-turning nut, thereby moving said nut in a vertical direction along said screw, and e. where said nut further comprises left and right arms having wheeled trucks attached to distal ends of the arms, and extending left and right from said jack nut to said door tracks, where said trucks travel along the tracks, and f. whereby when said jack is operated, said arms and trucks move vertically in response to the operation of said jack and raise or lower said track and connected door to provide access to an interior of the shelter.

* * * * *